United States Patent [19]

List

[11] Patent Number: 4,915,529

[45] Date of Patent: Apr. 10, 1990

[54] SEALING CAP FOR WRITING, DRAWING OR PAINTING INSTRUMENT

[75] Inventor: Holger List, Pyrbaum, Fed. Rep. of Germany

[73] Assignee: J. S. Staedtler GmbH & Co., Nuremberg, Fed. Rep. of Germany

[21] Appl. No.: 237,899

[22] Filed: Aug. 29, 1988

[30] Foreign Application Priority Data

Aug. 29, 1987 [DE] Fed. Rep. of Germany ..... 3728896

[51] Int. Cl.[4] ..... B43K 5/00

[52] U.S. Cl. ..... 401/202; 401/243; 401/262; 215/307

[58] Field of Search ..... 401/243, 244, 245, 246, 401/247, 202, 213, 98, 217; 24/10 R, 11 R, 11 PP, 11 CC, 11 HC; D19/41, 43, 57, 56; 215/307; 220/367

[56] References Cited

U.S. PATENT DOCUMENTS

| | | | |
|---|---|---|---|
| D. 177,359 | 4/1956 | Young et al. | D19/56 |
| D. 252,934 | 9/1979 | Carré | D19/56 |
| D. 256,926 | 9/1980 | Oka | D19/57 |
| 4,643,605 | 2/1986 | Iwasaki | 401/243 |

FOREIGN PATENT DOCUMENTS

| | | | |
|---|---|---|---|
| 0204252 | 12/1986 | European Pat. Off. . | |
| 2514041 | 10/1976 | Fed. Rep. of Germany | 24/11 R |
| 1209784 | 3/1960 | France | 215/307 |
| 33364 | 10/1921 | Norway . | |
| 2174374 | 11/1986 | United Kingdom . | |

*Primary Examiner*—Richard J. Apley
*Assistant Examiner*—D. F. Crosby
*Attorney, Agent, or Firm*—Toren, McGeady & Associates

[57] ABSTRACT

A sealing cap for a writing, drawing or painting instrument includes an axially extending tubular member open at one end to receive the instrument. An interior space extends axially within the tubular member from the open end and is closed at the opposite end. An axially extending air channel, open at both ends, is located within tubular member. One open end of the air channel opens to an at least partially laterally closed space which is open outwardly from the closed end of the interior space. The other open end of the air channel is open to the interior space. The air channel does not interfere with the sealing effect of the interior space when an instrument is inserted into the space. Accordingly, whether the cap is fitted on the instrument or is removed from it, there is a continuous open path for the flow of air through the air channel.

7 Claims, 2 Drawing Sheets

SEALING CAP FOR WRITING, DRAWING OR PAINTING INSTRUMENT

BACKGROUND OF THE INVENTION

The present invention is directed to a sealing cap for a writing, drawing or painting instrument with an opening for inserting the instrument into an interior space closed at the opposite end from the opening. At least one axially continuous air channel extends at least partly along the sealing cap.

Such a cap is disclosed in the Great Britain Patent Publication No. 21 74 374 A.

The patent publication discloses a sealing cap with a plurality of axially extending channels on the outside of a shaft with the channels being open radially outwardly and in communication with the interior of the cap by perforations in an end of the cap. If such a cap is swallowed, for example by a child, sufficient air should be supplied along the outer channels to prevent asphyxiation and, accordingly, keep such a possibly endangered person alive until medical attention is available.

Since outer channels and radial perforations can become soiled and partially blocked relatively easily in the normal use of the sealing cap, the required passage of air is not always insured. Moreover, such channels, formed by grooves and ribs located on the outside of the cap, impair the visual or aesthetic appearance the sealing cap and of the entire writing instrument and, accordingly, limit considerably the design possibilities of the cap.

In other sealing caps, such as disclosed in the patent publications EP 0 204 252 A1, NO-PS 33 264 and JP-GN/AS 61-11016, axial and/or radial perforations and, in part, channels within one end or on the outside of the sealing caps are suggested for providing air passages and preventing compression or the formation of a vacuum when opening or closing the instrument.

Many writing, drawing or painting instruments frequently have a tip part only pressed into an instrument shaft and this tip part usually fits securely into a sealed zone of the cap shaft. Unfortunately, the tip part can be accidentally detached from the instrument, particularly in older instruments, so that the tip part may remain in the cap when the sealing cap is removed with the result that an axially continuous aeration passageway would not be available. Furthermore, the outlet openings of the air passageways can also be easily blocked in such instruments.

SUMMARY OF THE INVENTION

Therefore, it is primary object of the present invention to provide a sealing cap free of the known disadvantages and affording a constantly open, axially continuous air passage or channel without interfering with the sealing function of the sealing cap. Further, the external design features of the cap are not impaired and the greatest possible security is available.

In accordance with the present invention, the sealing cap is formed by a tubular member defining an axially elongated interior space to receive the tip of an instrument. The tubular member also includes at least one axially extending air channel. The air channel is located within the tubular member and is open at both ends spaced apart in the axial direction. One end of the air channel is in flow communication with the interior space and the other end is in flow communication with an at least partially closed space located outwardly from the closed end of the tubular member.

Additional features and embodiments of the present invention are set forth in the claims.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 2*a* is an end view of the sealing cap illustrated in FIG. 2, viewed in the direction of the arrow a;

DETAILED DESCRIPTION OF THE INVENTION

Figure 1:
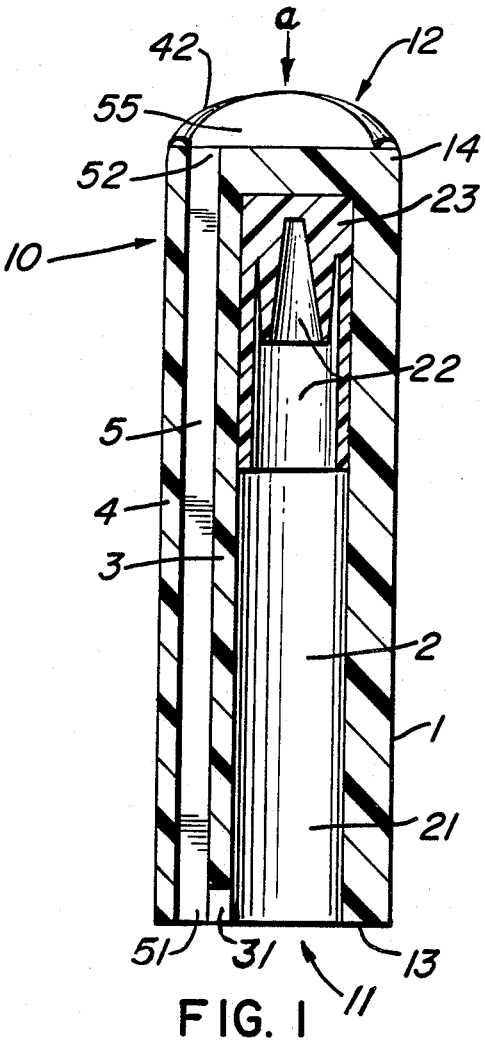
FIG. 1 is an axially extending cross-sectional view of one embodiment of a sealing cap incorporating the present invention.
Figure 1A:
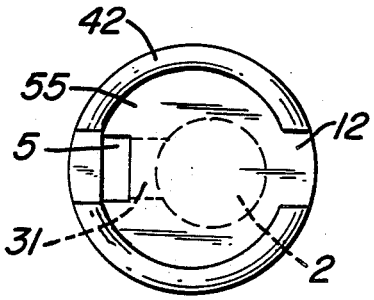
FIG. 1*a* is an end view of the sealing cap viewed in the direction of the arrow a in FIG. 1.

In FIGS. 1 and 1*a*, an axially extending sealing cap 10 is depicted formed by an axially extending tubular member 1 open at one end 11 and closed at the other end 12. Tubular member 1 defines an axially extending interior space 2. The interior space 2 has an insertion opening 21 and contains a seal insert 23 at the opposite end of the space from the opening 21. Seal insert 23 forms a seal zone 22 shown schematically for receiving a writing, drawing, or painting instrument. An air channel 5 is formed within the tubular member 1 and in the radially outward direction the air channel is closed by a cover wall 4 and is separated from the interior space by an axially extending intermediate wall 3. The air channel 5 is open at its opposite ends with an opening 51 at the inserting end 11 of the tubular member and an opening 52 at the opposite end, that is, the closed end 12 of the tubular member 1. At the closed end 12 of the tubular member, the upper end as viewed in FIG. 1, two semicircular edge walls 42 extend outwardly from the closed end. As can be seen in FIG. 1, the edge walls 42 curve upwardly on diametrically opposite sides of the tubular member from the end face at the closed end 12 of the cap. As a result, the edge walls 42 form a partially laterally closed open space 55 on the outside of the closed end 12 of the cap. At its end 52, the air channel 5 opens into or communicates with the open space 55. At its opposite end 51, the air channel 5 communicates with the interior space 2 in the sealing cap and also with the insertion opening 21 via a wall opening 31 in the end of the intermediate wall 3. Accordingly, a flow of air is possible between the closed end 12 of the cap and its open end 11 at the insertion opening 21. Air can flow in either direction through the air channel 5. When the axially extending interior space 2 within the tubular member 1 is closed from the outside, air can flow into the open space 55 encircled by the edge walls 42 at the closed end 12 of the tubular member and pass through the opening 52 into the air channel and then out of the opening 51 and/or through the wall opening 31, and possibly the insertion opening 21 at the open end 11.

Figure 2:
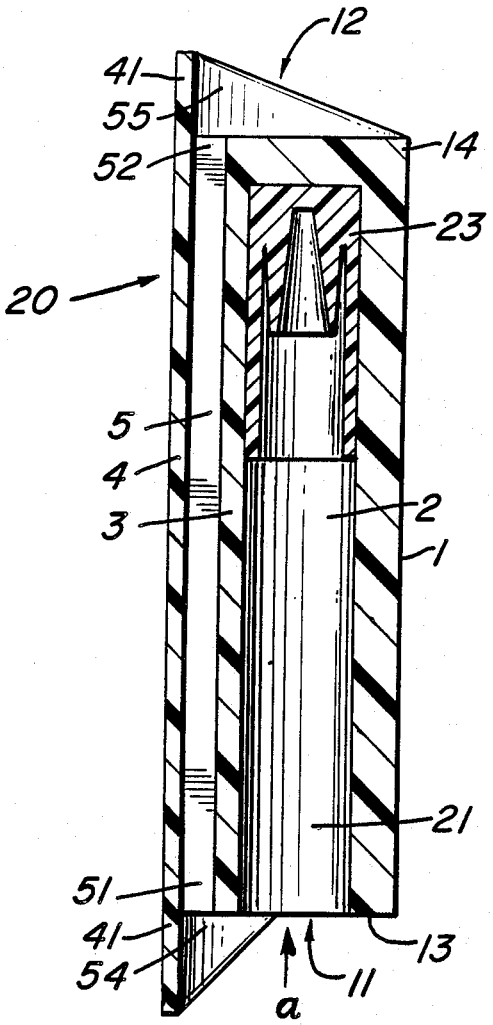
FIG. 2 is an axially extending sectional view of another embodiment of the sealing cap according to the present invention.
Figure 2A:
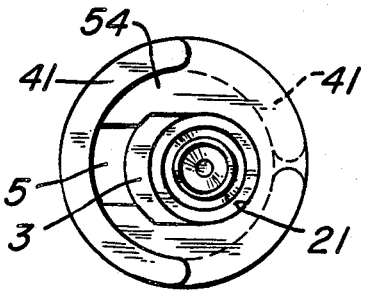

In FIGS. 2 and 2*a*, another sealing cap 20 is displayed which is a modification of the sealing cap 10 of FIG. 1. In tubular member 1, an axially extending interior space 2 is provided having an insertion opening 21 at the open end 11 and a seal insert 23 at the closed end 12 of the interior space. Air channel 5 extends in the axial direction of the interior space 2 and is defined radially inwardly by the intermediate wall 3 and radially outwardly by a cover wall 4. At the open end 11 of the tubular member 1, there is a semicircular wall 41, note the lower end of FIG. 2, and the showing in FIG. 2*a*, which partially encircles an insertion end open space 54.

At the opposite end of the air channel 5, that is the upper end in FIG. 2, an opening 52 is in communication with an open space 55 which, similar to the lower end of the sealing cap 20, is defined by a circumferentially edge wall 41 extending axially outwardly from the closed end 12 and forming a continuation of the cover wall 4. As can be seen in FIG. 2, the lower edge wall 41 only extends for half of the circumference of the open end 11 of the tubular member 1, however, the upper edge wall 41 extends around substantially the entire circumferential edge of the upper closed end 12 of the tubular member 1. Each of the edge walls 41, 41 slopes from a maximum height at the air channel 5 to the surface of the open or closed end 11 or 12 of the sealing cap 20. The edge walls 41 correspond to the edge walls 42 shown in FIGS. 1 and 1*a* and form at least a partial lateral enclosure for the open space 54, 55.

Figure 3:
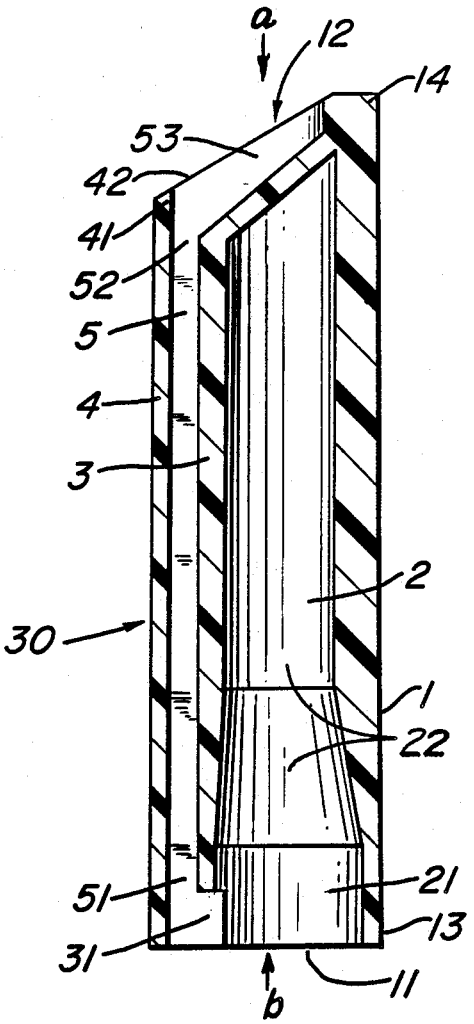
FIG. 3 is an axially extending sectional view of a third embodiment of the present invention.
Figure 3A:
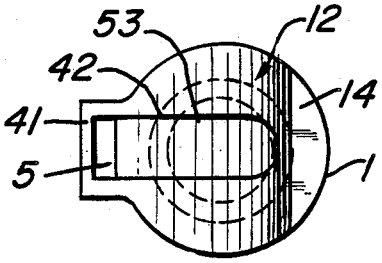
FIG. 3*a* is an end view of the sealing cap, taken in the direction of the arrow of a in FIG. 3.
Figure 3B:
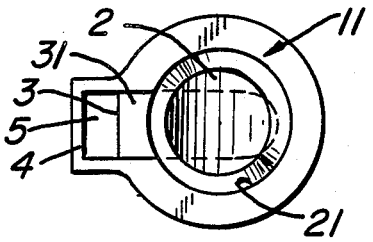
FIG. 3*b* is an end view of the sealing cap taken in the direction of the arrow b in FIG. 3.

In FIGS. 3, 3*a* and 3*b*, a sealing cap 30 is set forth with a tubular member 1 defining an interior space 2 with a closed end 12 and an open end 11. Interior space 2 has an insertion opening 21 which widens toward the open end 1 of the tubular member. An air channel 5 is located within the tubular member 1 and is separated from the interior space 2 by a radially inner intermediate wall 3. Intermediate wall 3 is spaced axially inwardly from the open end 11. Accordingly, the intermediate wall 3 is spaced axially from the lower end 13 of the tubular member 1. As a result, a wall opening 31 is formed between the opening 51 adjacent the open end 11 of the sealing cap 30 so that the air channel 5 communicates directly with the insertion opening 21 via the wall opening 31. At its upper end, the air channel 5 has an opening 52 into a recessed space 53 in the closed end 12 of the tubular member 1 with the recessed space 53 being laterally enclosed by a partial wall 41 extending axially outwardly from the cover wall 4 of the air channel 5, by edge walls 42 which extend around the closed end of the tubular member from the partial wall 41 to the extension of the tubular member 1 at the end wall 14. Accordingly, the air channel 5 with its open ends 51, 52 forms a flow passage connecting the recessed space 53 with the insertion opening 21 at the open end 11 of the cap 30.

Figure 4:
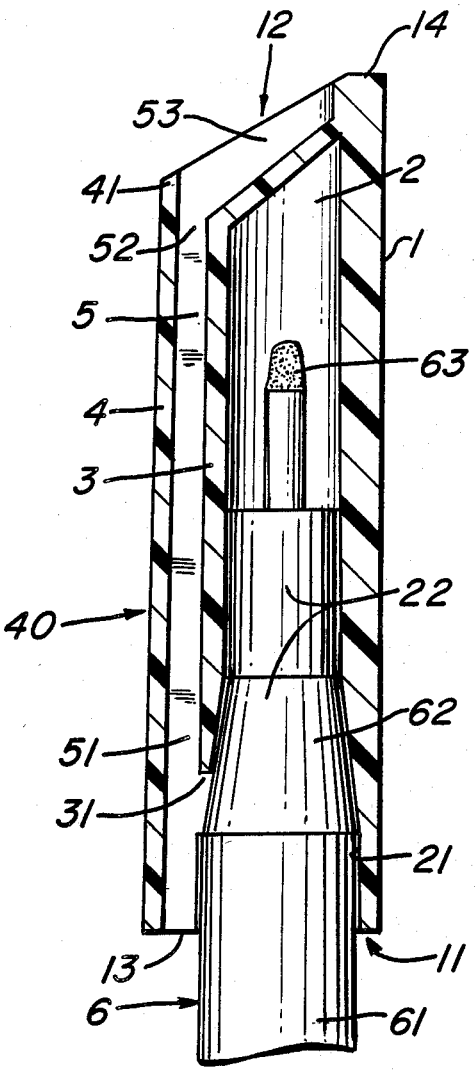
FIG. 4 is an axially extending view of still another embodiment of the sealing cap incorporating the present invention somewhat similar to the cap shown in FIG. 3 and with an inserted writing instrument.

In FIG. 4, another sealing cap 40 is displayed with the cap fitted onto the tip end 62 of a writing instrument 6. In place of the writing instrument 6, any other writing, drawing or painting instrument could be used. The sealing cap 40 corresponds substantially to the sealing cap 30 in FIGS. 3, 3*a* and 3*b*, and air circulation is possible within the tubular member 1 through the air channel 5 between the closed end 12 of the tubular member and the open end 11. The air can flow through the opening 52 into the upper end of the air channel 5 down to the open end 51 adjacent the insertion or open end 11, though the instrument 6 is fitted tightly in a press fit or by screwing into the interior space 2 of the sealing cap 40 with the instrument shaft 61 inserted into the cap and with its tip 62 and writing tip 63 enclosed within the interior space 2. With the arrangement as shown in FIG. 4, it is still possible to provide a flow of air through the air channel 5 from one end to the other of the sealing cap 40.

The sealing zone 22 of the sealing cap 40 contacts the instrument tip 62 forming an air tight closure of the interior space 2, whereby the writing tip 63, formed in the manner of a fiber wick, is hermetically sealed. The intermediate wall 3 is shortened in the axial direction so that it is spaced from the insertion end 13 of the tubular member 1 with the intermediate wall forming a part of the seal between the cap 40 and the instrument 6. As a result, the intermediate wall along with the remaining inside peripheral surface of the opening into the interior space 2 forms a complete circumferentially extending seal in the seal zone 22. If sealing cap 40 is removed from the writing instrument 6, air circulates at the open end 11 through the wall opening 31 from the opening 51 of the air channel 5 into the interior space 2 or the insertion opening 21. As a result, an air tight or water tight seal of the sealing cap 40, detached from the writing instrument 6 is always securely prevented.

Air channel 5 is dimensioned with respect to size so that the passage volume is adequate for the flow of air through the of sealing cap. In principle, the cross-sectional arrangement of the air channel is optional and can be adapted to the geometry of the sealing cap or otherwise selected according to need or desire.

For safety reasons, the cross-sectional surface of air channel 5, the air channel openings 51, 52, the recessed space 53 and the at least partially laterally closed spaces 54, 55, should be continuous and should be at least 5 to 10 $mm^2$ in order to prevent the risk of asphyxiation in a sufficiently effective manner.

While specific embodiments of the invention have been shown and described in detail to illustrate the application of the inventive principles, it will be understood that the invention may be embodied otherwise without departing from such principles.

I claim:

1. Sealing cap for a writing, drawing or painting instrument comprising an axially elongated tubular member for placement over a tip of the instrument, said tubular member having a first end and a second end spaced apart in the axial direction, said first end being open to receive the tip of the instrument and said second end being closed, said tubular member having an axially extending interior space therein for receiving the tip of the instrument inserted through the first end with the interior space being closed by said second end, at least one axially extending air channel extending in the axial direction of and at least along an axially extending portion of said tubular member, wherein the improvement comprises that said air channel is located within said tubular member, said air channel having a first open end and a second open end spaced apart in the axial direction thereof, said air channel has an axially extending radially outer wall closed between the first and second open ends and an axially extending radially inner wall separating said air channel from said interior space and being closed along the axial extent thereof, first means adjacent the first end of said tubular member for interconnecting the first open end of said air channel and said interior space, and second means adjacent the second end of said tubular member extending axially outward from said second end forming an at least partially laterally closed space being in communication with the second open end of said air channel.

2. Sealing cap, as set forth in claim 1, wherein said at least partially laterally closed space is formed as a recess in the second end of said tubular member with the closed second end of said tubular member closing one surface of the recessed space and with the second open end of said air channel being open to said recessed space.

3. Sealing cap, as set forth in claim 1, wherein said tubular member has a generally circular circumferentially and axially extending outside wall with an axially extending portion thereof projecting outwardly from said circular outside wall and defining the outer surface of said air channel.

4. Sealing cap, as set forth in claim 1, wherein said first means and said second means comprise at least edge walls extending axially outwardly from the first and second ends of said tubular member for at least partially laterally enclosing a space at each of the ends of said tubular member.

5. Sealing cap, as set forth in claim 1, wherein an edge wall located at at least one of the first and second ends of said tubular member with said edge wall projecting in the axial direction of said tubular member outwardly from the end and said edge wall having its maximum axial extent in alignment with said air channel.

6. Sealing cap, as set forth in claim 5, wherein said edge wall slopes from the maximum axial extent thereof toward the end of said tubular member from which said edge wall projects for at least a radially outer circumferentially extending portion of the end of said tubular member.

7. Sealing cap, as set forth in claim 1, wherein an intermediate wall within said tubular member forms the radially inner wall of said air channel and separates said air channel from said interior space, and said first means comprises an opening in said intermediate wall adjacent said first end of said tubular member forms a connecting opening between said air channel and said interior space.

* * * * *